US009775456B2

(12) United States Patent
Catania

(10) Patent No.: US 9,775,456 B2
(45) Date of Patent: Oct. 3, 2017

(54) FASHION ACCESSORY AND METHOD OF OPERATING A ZIPPER

(71) Applicant: Natalie Catania, Mississauga (CA)

(72) Inventor: Natalie Catania, Mississauga (CA)

( * ) Notice: Subject to any disclaimer, the term of this patent is extended or adjusted under 35 U.S.C. 154(b) by 0 days.

(21) Appl. No.: 14/884,078

(22) Filed: Oct. 15, 2015

(65) Prior Publication Data

US 2016/0106249 A1 Apr. 21, 2016

Related U.S. Application Data

(60) Provisional application No. 62/064,213, filed on Oct. 15, 2014.

(51) Int. Cl.

| | |
|---|---|
| ***A47G 25/90*** | (2006.01) |
| ***A44B 19/26*** | (2006.01) |
| *A44C 15/00* | (2006.01) |
| *A44B 19/28* | (2006.01) |
| *A44C 5/00* | (2006.01) |

(52) U.S. Cl.

CPC ..... *A47G 25/902* (2013.01); *A44B 19/26* (2013.01); *A44B 19/285* (2013.01); *A44C 5/0007* (2013.01); *A44C 15/005* (2013.01)

(58) Field of Classification Search

CPC .... A47G 25/90; A47G 25/901; A47G 25/902; A44B 19/26; A44B 19/262; A44B 19/285; A45F 2005/023; A44C 15/005; A44C 5/0007

See application file for complete search history.

(56) References Cited

U.S. PATENT DOCUMENTS

| | | | | |
|---|---|---|---|---|
| 2,888,728 | A * | 6/1959 | Lebermann | A47G 25/902 294/3.6 |
| 2,908,057 | A * | 10/1959 | Blanco | A47G 25/902 223/111 |
| 2,939,193 | A * | 6/1960 | Morgan | A47G 25/902 294/3.6 |
| 3,249,977 | A * | 5/1966 | Cloud, Sr. | A47G 25/902 294/26 |
| D405,028 | S * | 2/1999 | Papernik | D11/221 |
| 9,289,084 | B1 * | 3/2016 | McKeown | A44B 19/262 |
| 2005/0279136 | A1 * | 12/2005 | Bowman | A44C 15/003 63/21 |
| 2013/0341940 | A1 * | 12/2013 | Taurman | A47G 25/902 294/3.6 |

* cited by examiner

*Primary Examiner* — Ismael Izaguirre

(74) *Attorney, Agent, or Firm* — Perry + Currier Inc.

(57) ABSTRACT

A fashion accessory and a method of operating a zipper are provided. The fashion accessory includes a flexible elongated element, a hook, and an attachment point disposed on the flexible elongated element. The fashion accessory is convertable between a configuration for wearing and a configuration for operating the zipper. The method involves wearing the fashion accessory in a configuration and converting the fashion accessory to allow the fashion accessory to engage a zipper.

16 Claims, 9 Drawing Sheets

FASHION ACCESSORY AND METHOD OF OPERATING A ZIPPER

CROSS-REFERENCE TO RELATED APPLICATION

This application claims priority from U.S. Provisional Patent Application 62/064,213, filed Oct. 15, 2014, the content of which is incorporated herein by reference.

FIELD

The present specification relates generally to a fashion accessory and more specifically relates to a fashion accessory capable of operating a zipper.

BACKGROUND

There are many challenges women face during the day, such as getting dressed. In particular, women have a challenging time opening and closing zippers on some garments, especially garments having a zipper on the back or side portion. Whether it be in their homes, while shopping in change rooms or any other time when they are on their own and or want to be independent, operating a zipper on the back or side of a dress can be difficult. Some women spend an average of 9 hours a year struggling to open and close their garments. These women also want to feel confident that they do not have to worry about their zipper being opened due to no being able to completely zip up a zipper.

SUMMARY

In accordance with an aspect of the invention, there is provided a fashion accessory for operating a zipper. The fashion accessory includes a flexible elongated element. The fashion accessory also includes a hook connected to a first end of the flexible elongated element. The hook is configured engage the zipper. The fashion accessory further includes an attachment point disposed on the flexible elongated element and configured to engage the hook. The fashion accessory is convertable between a first configuration and a second configuration the first configuration. The hook is engaged with the attachment point for wearing in the first configuration. The second configuration is configured to allow for operation of the zipper using the hook.

The attachment point may be adjustable along the flexible elongated element to adjust a size of the fashion accessory.

The attachment point may be disposed proximate to a second end of the flexible elongated element, the second end opposite the first end.

The fashion accessory may further include an ornament disposed at the second end of the flexible elongated element.

The attachment point may be disposed on the ornament.

The first configuration may form at least one of a necklace, a bracelet, or an anklet.

The flexible elongated element may be a chain.

The flexible elongated element may have a predetermined length. The predetermined length may be configured to assist a user to reach the zipper on a back of a dress when the fashion accessory is in the first configuration.

The predetermined length may be greater than about 12 inches.

The predetermined length may be greater than about 18 inches.

The predetermined length may be greater than about 24 inches.

In accordance with an aspect of the invention, there is provided a method of operating a zipper. The method involves wearing a fashion accessory in a first configuration wherein a hook is engaged with an attachment point. The hook is also connected to a first end of a flexible elongated element and the attachment point is disposed on the flexible elongated element. The method further involves disengaging the hook from the attachment point to convert the fashion accessory from the first configuration to a second configuration. The method also involves engaging the hook with the zipper. In addition, the method involves applying a pulling force on the flexible elongated element to operate the zipper.

The method may further involve adjusting the attachment point along the flexible elongated element to adjust a size of the fashion accessory.

The attachment point may be disposed proximate to a second end of the flexible elongated element, the second end opposite the first end.

Wearing the fashion accessory may involve wearing at least one of a necklace, a bracelet, or an anklet.

Applying the pulling force may involve applying the pulling force at a second end of the flexible elongated. The second end is opposite the first end.

Applying the pulling force may close the back of the dress.

BRIEF DESCRIPTION OF THE DRAWINGS

Reference will now be made, by way of example only, to the accompanying drawings in which.

DETAILED DESCRIPTION OF THE EMBODIMENTS

As used herein, any usage of terms that suggest an absolute orientation (e.g. "top", "bottom", "front", "back", etc.) are for illustrative convenience and refer to the orientation shown in a particular figure. However, such terms are not to be construed in a limiting sense as it is contemplated that various components will, in practice, be utilized in orientations that are the same as, or different than those described or shown.

Figure 1:
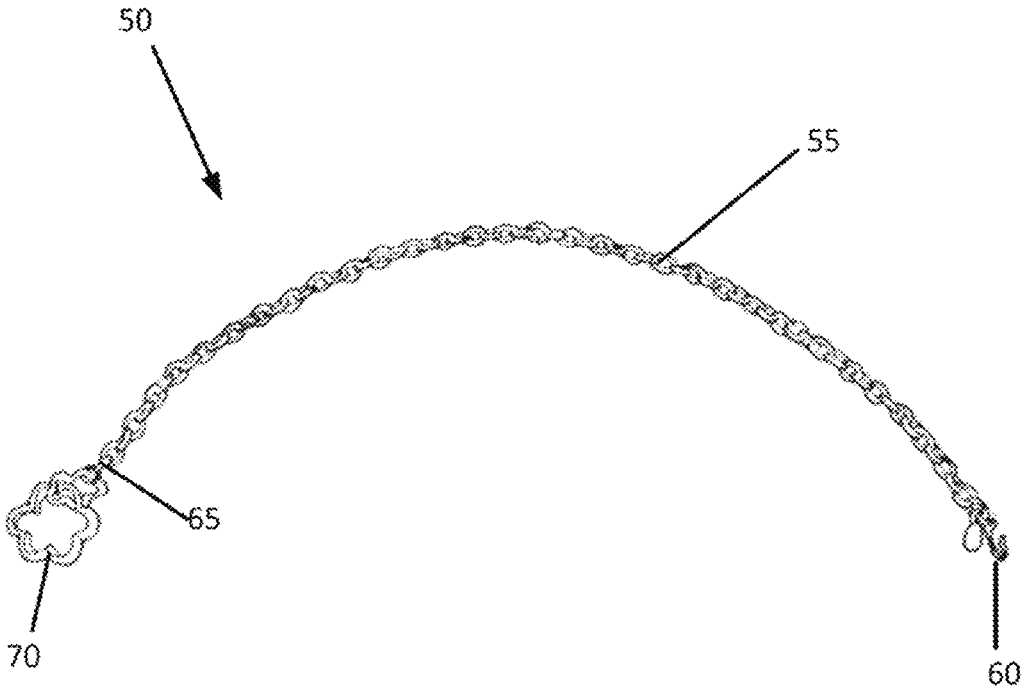
FIG. 1 is a representation of a fashion accessory in accordance with an embodiment.
Figure 2:
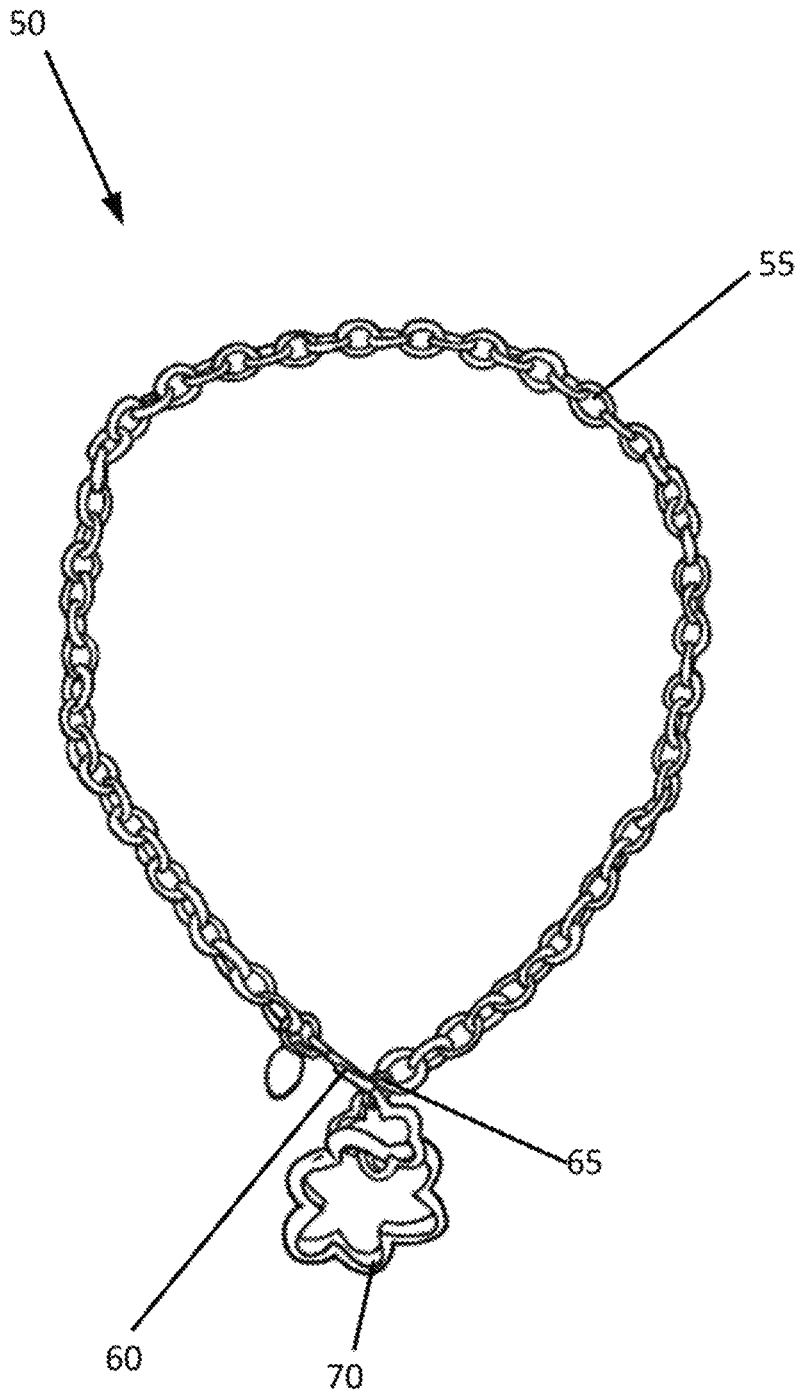
FIG. 2 is a representation of the fashion accessory shown in FIG. 1 in another configuration.

Referring to FIGS. 1 and 2, a fashion accessory for operating a zipper is shown generally at 50. It is to be understood that the fashion accessory 50 is purely exemplary and it will be apparent to those skilled in the art that variations of the fashion accessory for operating a zipper are contemplated. The fashion accessory 50 includes a flexible elongated element 55, a hook 60 connected to one end of the flexible elongated element 55, an attachment point 65 disposed on the flexible elongated element 55, and an ornament 70 disposed on the flexible elongated element 55. In the present embodiment, the fashion accessory 50 is generally convertable between at least two configurations, such as the configuration shown in FIG. 1 for operating a zipper with the hook 60 and the configuration shown in FIG. 2 having the hook 60 engage the attachment point 65 for wearing.

In the present embodiment, the flexible elongated element 55 is generally configured to physically connect the hook 60, the attachment point 65 and the ornament 70. It is to be understood that the flexible elongated element 55 is not particularly limited to any design and/or material and that several different variations are contemplated. In the present embodiment, the flexible elongated element 55 is a metallic chain, such as Gold, Yellow Gold, White Gold, Rose Gold, Sterling Silver, Silver, Platinum, Tin, Zinc, and or any other nickel allergy free metal that can be plated with silver, gold, white gold, rose gold, rhodium, chrome, zinc, or tin. In other embodiments, it is to be appreciated by a person of skill in the art with the benefit of this description that the flexible elongated element 55 can be modified to be a flexible piece of plastic, a woven string, fishing line, elastic ribbon, or any other material or design with suitable mechanical properties. For example, the flexible elongated element 55 is generally designed such that the tensile strength is sufficient for pulling a zipper.

As discussed above, the material and/or design of the flexible elongated element 55 is not limited and a person of skill in the art with the benefit of this description would recognize at least two types of designs by which the flexible elongated element 55 can be configured. As an example of the first design type, the flexible elongated element 55 can be a chain formed of rigid material such as metal, plastic, etc. It is to be appreciated that the size of the links of the chain are not particularly limited and can be varied depending on the material and a specific tensile strength. As an example of a second design type by which the flexible elongated element 55 can be configured, the flexible elongated element 55 can be made from a flexible material with sufficient tensile strength, such as woven string, synthetic fibers, and flexible plastics.

In the present embodiment, the hook 60 is generally configured to engage a zipper as well as the attachment point 65. It is to be understood that the hook 60 is not particularly limited to any specific design and/or material and that several different variations are contemplated. In particular, it is to be appreciated that the hook 60 is designed with appropriate dimensions and have sufficient rigidity to engage a zipper and the attachment point 65. Furthermore, the size of the hook 60 is not particularly limited and can be varied depending on factors such as the intended application. In the present embodiment, the hook 60 is U-shaped and approximately 17 mm to 20 mm long by approximately 3 mm to 5 mm wide by approximately 0.7 mm to 1.0 mm thick. In particular, the hook 60 of the present embodiment is 18.64 mm long by 4.15 mm wide by 0.912 mm thick.

Figure 3:
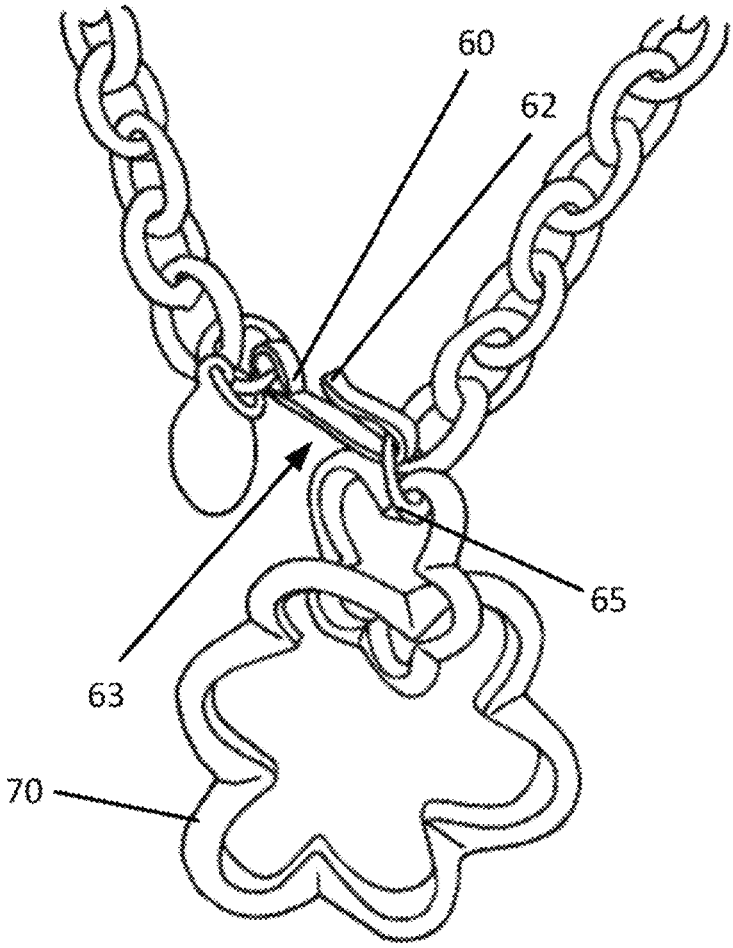
FIG. 3 is a representation of the fashion accessory shown in FIG. 1 showing a close-up view.

Referring to FIG. 3, a larger view of an embodiment of the hook 60 is shown in greater detail. In the present embodiment, the hook 60 includes an optional lip 62 and a narrow region 63 to facilitate engagement with at least one of the zipper or the attachment point 65. In the present embodiment, the hook 60 is generally rigid, but slightly resiliently deformable such that the narrow region 63 can be configured to inhibit the hook 60 from disengaging the zipper or attachment point 65 once engaged. Accordingly, it is to be appreciated by a person of skill in the art that the hook 60 deforms by a small amount to allow a ring of a zipper or the attachment point 65 to pass through the narrow region 63. In the present embodiment, the hook 60 is made from a bent piece of metal. In particular, the hook 60 is made from stainless steel to provide a rigid strong structure that can be sufficiently small and be compatible with smaller zippers that are sometimes found of articles of clothing. However, it is to be understood that the hook 60 is not particularly limited to a specific material and that several different variations are contemplated. For example, in other embodiments, the hook 60 can be made from a semi-rigid plastic material.

Furthermore, in additional embodiments, the hook 60 can be modified to be another type of fastener configured to engage an attachment point 65 and a zipper. For example, the hook 60 can be modified to be a clamp or magnetic fastener.

The attachment point 65 is disposed on the flexible elongated element 55 and generally configured to engage the hook. It is to be understood that the attachment point 65 is not particularly limited to any specific design and that several different variations are contemplated. In the present embodiment as shown in FIGS. 1 and 2, the attachment point 65 is a ring disposed proximate to the opposite end of the flexible elongated element 55 where the hook 60 is disposed. In particular, the present embodiment uses a ring made by soldering a circular piece of metal; however, it is to be appreciated that the attachment point is not necessarily soldered. Furthermore, it is to be appreciated by a person of skill in the art with the benefit of this description that the attachment point 65 need not be at an end of the flexible elongated element 55 and can be positioned at any point. For example, in embodiments where the flexible elongated element 55 includes a chain with links, any one of the links can be used as an attachment point.

Figure 4:
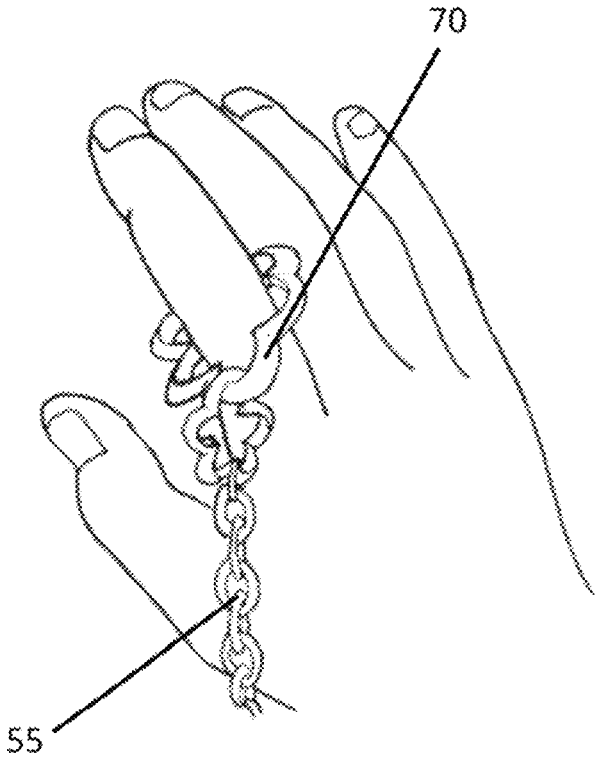
FIG. 4 is a representation of the fashion accessory shown in FIG. 1 showing a use of the fashion accessory.

In the present embodiment, the fashion accessory 50 further includes an optional ornament 70. The ornament 70 is not particularly limited and can be varied. In particular, the ornament 70 can have any shape and/or size. For example, the ornament 70 have a flower design such as illustrate in FIG. 1 or a heart design as illustrated in FIG. 8. In the present embodiment, the ornament 70 improves the aesthetic appearance of the fashion accessory 50 as well as provides a structure to facilitate operation as shown in FIG. 4. In particular, the ornament 70 can function as a holding point for a user during operation of the zipper by providing a better grip than if the user were to hold the flexible elongated element 55 directly.

It is to be appreciated by a person of skill in the art with the benefit of this description that the ornament 70 is optional and can be omitted. In embodiments without an ornament 70, it is to be understood that a portion of the flexible elongated element 55 can be used instead to pull the zipper. It is to be appreciated that such embodiments can provide the additional benefit of fewer parts for manufacturing as well as a simpler design. As another example of a variation, in other embodiments, the ornament 70 can also be used to function as the attachment point 65.

Referring back to FIG. 1, the fashion accessory 50 is shown in an open configuration for operating a zipper. In particular, the hook 60 is not engaged with the attachment point 65. In this configuration, the flexible elongated element 55 can be extended to a full length for operating a zipper using the hook 60.

Figure 5:
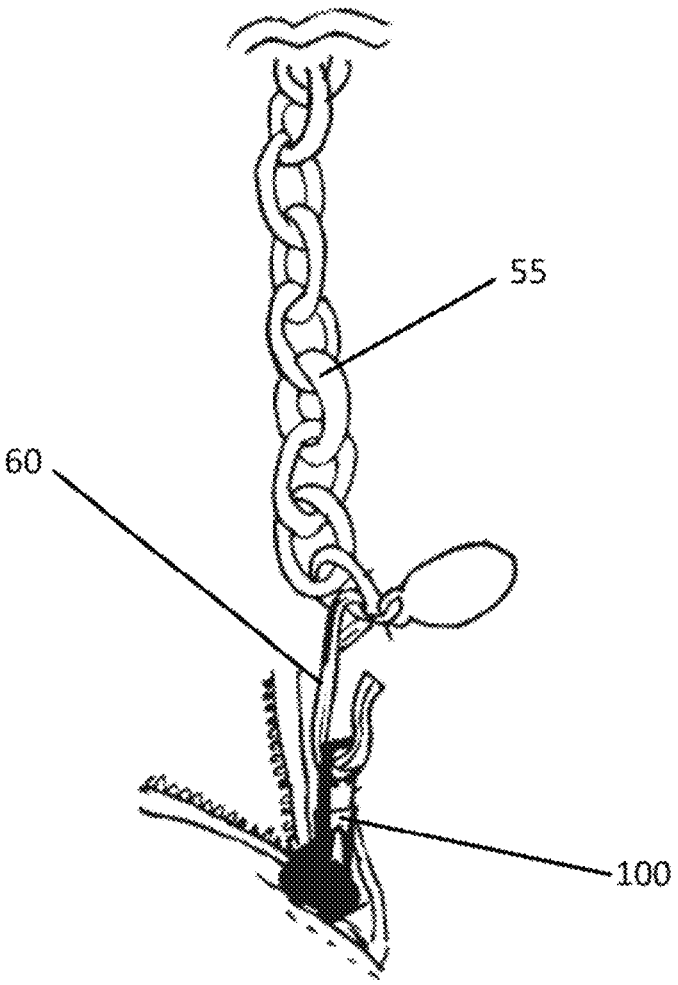
FIG. 5 is a representation of the fashion accessory shown in FIG. 1 showing the fashion accessory interacting with a zipper.
Figure 6:
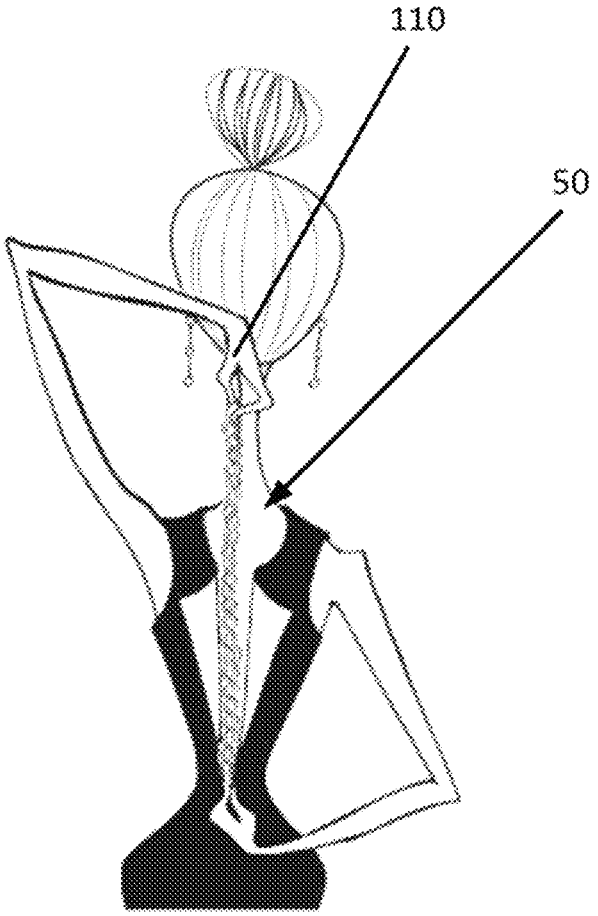
FIG. 6 is a representation of a fashion accessory in accordance with an embodiment being used on a dress.
Figure 7:
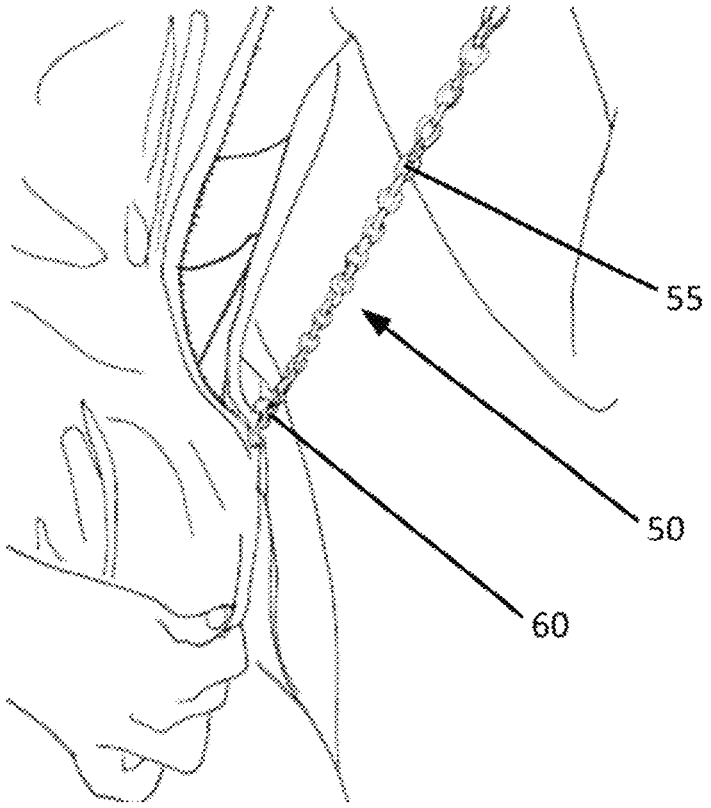
FIG. 7 is a representation of a fashion accessory in accordance with an embodiment being used on another dress.

FIGS. 5-7 illustrate use of the fashion accessory in the open configuration with a zipper 100. As shown in FIG. 5, the hook 60 engages a loop on the zipper 100. The fashion accessory 50 can be extended as shown in FIG. 6 to provide improved mechanics for pulling the zipper 100 on a back of a dress using the hand 110 over the head of a user. FIG. 7 illustrates another used of the fashion accessory 50 for operating a zipper on the side of a dress.

It is to be appreciated by a person of skill in the art with the benefit of this description that the size of the fashion accessory 50 can be modified to be compatible with specific applications. For example, the flexible elongated element 55 of the fashion accessory 50 can be a predetermined length that is designed to assist the user reach the zipper 100 on the back of the dress as shown in FIG. 6. It is to be appreciated that the predetermined length is not limited and can be varied depending on various factors such as the intended application or the types of articles of clothing with which the fashion accessory 50 is compatible. For example, in some embodiments, the flexible elongated element 55 can be at least about 12 inches. It is to be appreciated by a person of skill in the art with the benefit of this description that for dresses with lower zippers, the flexible elongated element 55 can be at least about 18 inches. Furthermore, for a user of above average height, the flexible elongated element 55 can be at least about 24 inches. In other embodiments, the flexible elongated element 55 can be at least about 30 inches.

Furthermore, it is to be appreciated by a person of skill in the art that the fashion accessory 50 is not particularly limited to use with any type of article of clothing and that various articles of clothing and wearable accessories can be compatible with the fashion accessory 50. For example, the fashion accessory 50 can be used with footwear, such as boots, sandals, or shoes, pants, jackets, and shirts. Accordingly, it is to be appreciated that the fashion accessory 50 can be used as a tool or aid for a user with limited motion or other impairment that can make the operation of a zipper difficult.

Referring back to FIG. 2, the fashion accessory 50 is in a closed configuration for wearing. In particular, the hook 60 is engaged with the attachment point 65. In this configuration, the fashion accessory 50 can function as a necklace as shown in FIG. 2.

Figure 8A:
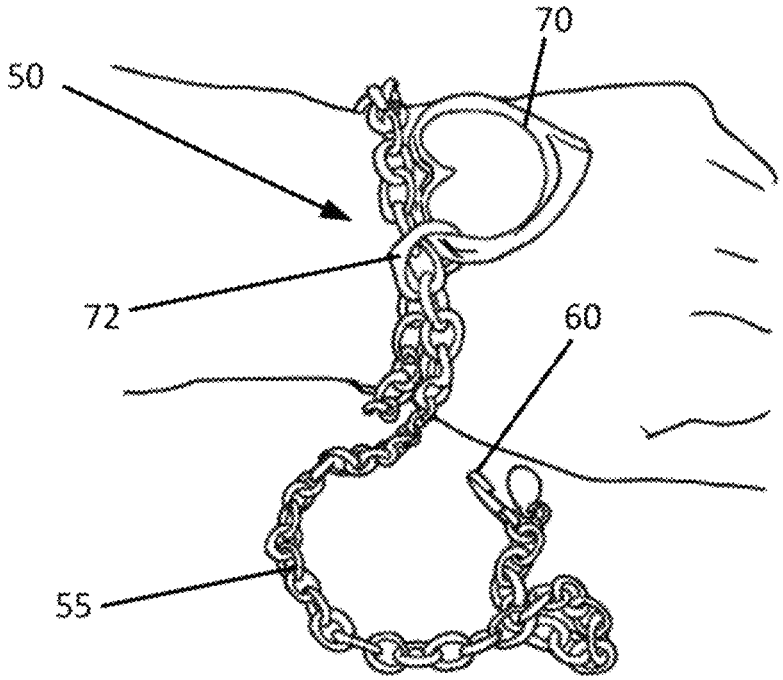
FIG. 8A-B are representations of a fashion accessory in accordance with an embodiment as a bracelet.
Figure 8B:
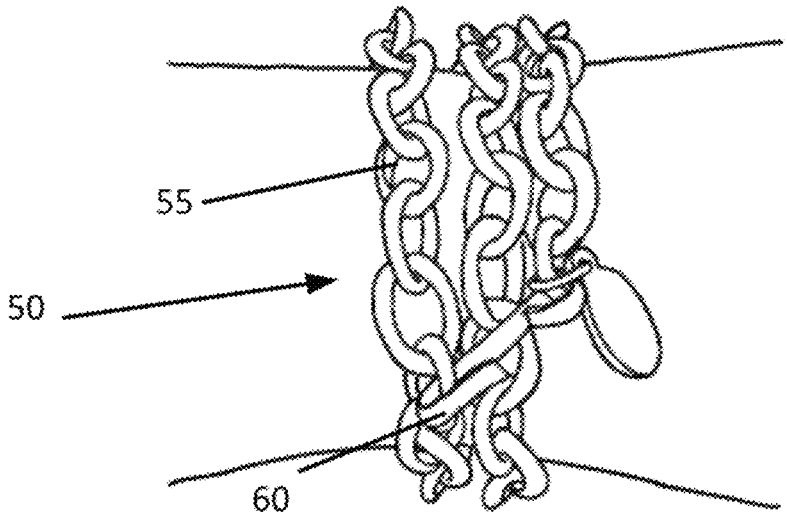

FIGS. 8A and 8B illustrate an alternative closed configuration. In FIG. 8A, the flexible elongated element 55 is threaded through a guiding ornament 72. The flexible elongated element 55 is then subsequently wrapped around a user's wrist and the hook 60 is engaged with one of the links in the elongated element 55 as shown in FIG. 8B. Accordingly, it is to be appreciated by a person of skill in the art with the benefit of this description that the fashion accessory 50 can also function as a bracelet.

Figure 9:
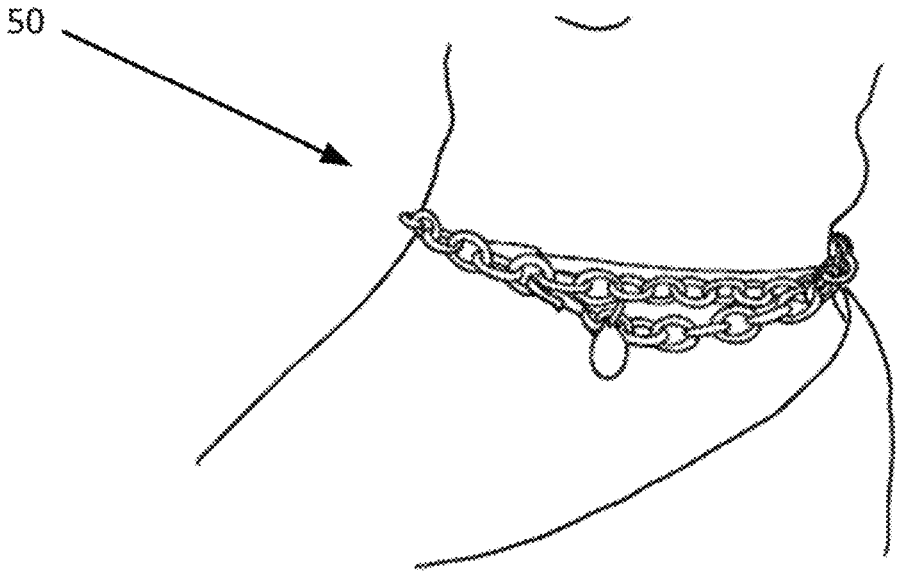
FIG. 9 is a representation of a fashion accessory in accordance with an embodiment as an anklet.

FIG. 9 illustrate another alternative closed configuration. As shown in FIG. 9, the fashion accessory 50 is wrapped around a user's ankle. Accordingly, it is to be appreciated by a person of skill in the art with the benefit of this description that the fashion accessory 50 can also function as an anklet.

It is to be re-emphasized that the structures described herein are a non-limiting representation only. In particular, it is to be understood that the fashion accessory 50 is not particularly limited. For example, the hook 60 can be disposed at another point on the flexible elongated element 55. As another example of a variation, the hook 60 can be adjustable and be disposed at any point that is convenient. Further variations can include the addition of multiple ornaments as well as substitution with various ornaments. As another example of a variation, the fashion accessory can also be worn as a headband.

Various advantages will now be apparent to a person of skill in the art. In particular, the fashion accessory 50 provides a dual function. In particular, it allows a user to use the fashion accessory 50 as a decorative accessory. Accordingly, any portion of the fashion accessory 50 can be further customized and/or decorated such as modifying decorative features and/or color. In situations when the user requires assistance with operating a zipper, the user can simply convert the fashion accessory 50 into an open position to facilitate operation of the zipper. By providing this additional functionality on the fashion accessory, it will remove the requirement to carry a second separate device to facilitate the operation of a zipper on the back of a dress.

While specific embodiments have been described and illustrated, such embodiments should be considered illustrative only and should not serve to limit the accompanying claims.

What is claimed is:

1. A fashion accessory for operating a zipper, the fashion accessory comprising:

a flexible elongated element;

a hook connected to a first end of the flex elongated element, the hook configured engage the zipper; and an attachment point disposed on the flexible elongated element and configured to engage the hook, wherein the attachment point is adjustable along the flexible elongated element such that the hook can engage the elongated element at multiple positions, wherein the fashion accessory is convertable between a first wearable configuration and a second configuration, wherein the hook is engaged with the attachment point for wearing in the first wearable configuration, and wherein the second configuration is configured to allow for operation of the zipper using the hook.

2. The fashion accessory of claim 1, wherein the attachment point is disposed proximate to a second end of the flexible elongated element, the second end opposite the first end.

3. The fashion accessory of claim 1, further comprising an ornament disposed at the second end of the flexible elongated element.

4. The fashion accessory of claim 3, wherein the attachment point s disposed on the ornament.

5. The fashion accessory of claim 4, wherein the first wearable configuration forms at least one of a necklace, a bracelet, or an anklet.

6. The fashion accessory of claim 1, wherein the flexible elongated element is a chain.

7. The fashion accessory of claim 1, wherein the flexible elongated element has a predetermined length, the predetermined length configured to assist a user to reach the zipper on a back of a dress when the fashion accessory is in the first wearable configuration.

8. The fashion accessory of claim 7, wherein the predetermined length is greater than about 12 inches.

9. The fashion accessory of claim 8, wherein the predetermined length is greater than about 18 inches.

10. The fashion accessory of claim 9, wherein the predetermined length is greater than about 24 inches.

11. A method of operating a zipper using a fashion accessory, the method comprising:

selecting an attachment point from multiple positions along a flexible elongated element such that a hook can engage the elongated element;

engaging the hook with the attachment point to form a first wearable configuration, wherein the hook is connected to a first end of a flexible elongated element;

wearing the fashion accessory in the first wearable configuration;

disengaging the hook from the attachment point to convert the fashion accessory from the first wearable configuration to a second configuration;

engaging the hook with the zipper; and applying a pulling force on the flexible elongated element to operate the zipper.

12. The method of claim 11, wherein the attachment point is disposed proximate to a second end of the flexible elongated element, the second end opposite the first end.

13. The method of claim 11, wherein wearing the fashion accessory comprises wearing at least one of a necklace, a bracelet, or an anklet.

14. The method of claim 11, wherein applying the pulling force comprises applying the pulling force at a second end of the flexible elongated element, the second end opposite the first end.

15. The method of claim 11, wherein the zipper is disposed on a back portion of a dress, wherein the back portion is difficult to reach with a hand of a wearer.

16. The method of claim 15, wherein applying the pulling force closes the back of the dress.

* * * * *